United States Patent [19]

Clark, Jr.

[11] 4,000,729

[45] Jan. 4, 1977

[54] IGNITION SYSTEM BYPASS UNIT

[76] Inventor: Jack Clark, Jr., Box 122, Milan, Ind. 47445

[22] Filed: Apr. 23, 1975

[21] Appl. No.: 570,841

[52] U.S. Cl. ..... 123/148 DS; 123/148 E

[51] Int. Cl.[2] ..... F02P 1/00

[58] Field of Search ..... 123/148 E, 148 DS, 148 S

[56] References Cited

UNITED STATES PATENTS

| | | | |
|---|---|---|---|
| 2,152,650 | 4/1939 | Kilborn | 123/148 DS |
| 2,412,540 | 12/1946 | Sellaro | 123/148 DS |

*Primary Examiner*—Charles J. Myhre
*Assistant Examiner*—Ronald B. Cox
*Attorney, Agent, or Firm*—Jenkins, Hanley & Coffey

[57] ABSTRACT

An ignition system bypass unit for quick and easy connection to an electronic automobile ignition system having malfunctioning electronic components. The unit bypasses electronic ignition components to apply a string of pulses across the primary winding of the engine ignition coil. These pulses induce a corresponding string of high voltage pulses in the ignition coil secondary winding for distribution to the engine spark plugs to allow at least temporary engine operation.

6 Claims, 4 Drawing Figures

IGNITION SYSTEM BYPASS UNIT

BACKGROUND OF THE INVENTION

This invention relates to automobile ignition systems, and more specifically, to a pulse generating unit for bypassing malfunctioning electronic components of an electronic ignition system. The unit supplies ignition pulses to the engine ignition coil to permit temporary engine operation and thereby allow the vehicle to be driven to a safe and convenient repair area.

The electronic ignition system is rapidly being accepted throughout the automobile industry as a modern and essentially maintenance-free replacement for the conventional mechanical ignition system. Such an electronic system typically comprises a magnetic pickup assembly coupled to a solid state electronic module which is in turn coupled to the primary winding of an engine ignition coil. The pickup assembly has a toothed armature, with one tooth for each engine cylinder, mounted for rotation about a distributor shaft and arranged to cyclically interrupt the magnetic field of a permanent magnet to induce a string of low voltage pulses in a pickup coil. The electronic module allows current to flow in the ignition coil primary winding upon receipt of each pulse from the pickup coil, and then cuts off that current upon termination of the pickup coil pulse to induce a high voltage pulse in the ignition coil secondary circuit for distribution to an engine spark plug.

Electronic ignition systems are highly advantageous over conventional mechanical ignition systems because of their replacement of mechanical switching components with electronic circuitry. More specifically, the magnetic pickup assembly and the electronic module contain no mechanical contact points to thus eliminate the conventional breaker points, rubbing block, etc. of a mechanical ignition system. As a result, the pickup assembly and the electronic module normally require little maintenance, and are thereby more long-lived than mechanical components. Further, the electronic components enable the generation of considerably higher sparking voltages than in a mechanical system to increase spark plug life and improve engine operating conditions.

Unfortunately, electronic ignition systems have not completely eliminated ignition system maintenance. Instead, electronic systems have presented the automobile industry with some new and perplexing maintenance problems. For example, while the pickup assembly and the electronic module of an electronic system are generally more long-lived than their mechanical counterparts, these electronic components do occasionally break down and fail to operate. In electronic systems, such failure is usually without any warning whatsoever, and renders the engine completely inoperable until the problem is solved or the malfunctioning component is replaced. In older mechanical systems, many causes of ignition failure could be temporarily remedied by simple "on the spot" adjustments of the mechanical ignition components which were almost always mounted in an easily accessible location. However, with modern electronic systems, the components are usually located in a substantially sealed distributor housing, and are thereby neither readily accessible nor easily adjustable. Further, the electronic module usually comprises microminiature circuitry and can be serviced only by complete replacement. All of this makes repair or replacement of the electronic ignition components an expensive and time-consuming task. Such repair simply cannot be safely or conveniently accomplished when the vehicle becomes disabled on a busy street, or during inclement weather. Accordingly, the vehicle operator is all too often obliged to incur the expense of having the vehicle towed to a safe, convenient repair location.

Some testing instruments are available for pinpointing ignition problems to the electronic components of the ignition system. These instruments can be electrically coupled to the magnetic pickup assembly, or to the electronic module, to indicate by means of a light or the like if the particular component is malfunctioning. Repair or replacement of the malfunctioning component, however, is still a time-consuming and intricate task which cannot be effectively performed on a vehicle stranded on a busy street or during foul weather. Towing of the vehicle to a safe repair location is still almost always required.

It is therefore desirable to provide an ignition unit for connection to an automobile's electronic ignition system, which bypasses the electronic ignition components, and which provides ignition pulses to allow at least temporary operation of the vehicle engine so that the vehicle can be driven to a safe repair area. Further, it is desirable to provide such an ignition bypass unit which is quickly and easily connected to the automobile ignition system, and which is both inexpensive to manufacture and compact in size.

SUMMARY OF THE INVENTION

In accordance with the invention, an ignition unit for bypassing the electronic components of an electronic automobile ignition system is provided comprising a vibrating relay circuit mounted within a relatively small housing. A first pair of leads extend from the housing for connecting the relay circuit across the terminals of the automobile storage battery, and a second pair of leads extend from the housing for connecting the circuit output across the primary winding of the engine ignition coil. A manual on-off switch on the housing controls the energization of the relay circuit.

The bypass unit is used by first disconnecting all existing electrical connections of the ignition coil primary winding with the electronic ignition components and the storage battery. Then, the first pair of unit leads are connected across the battery terminals and the second pair are connected across the coil primary. Closing the on-off switch energizes the relay circuit to supply a relatively high frequency string of low voltage pulses through the ignition coil primary. These low voltage pulses induce a corresponding frequency string of relatively high voltage pulses in the ignition coil secondary circuit. Cranking of the engine with the engine starter motor causes distribution of a sufficient number of the secondary pulses to the engine spark plugs to start and run the engine.

BRIEF DESCRIPTION OF THE DRAWINGS

The accompanying drawings illustrate the invention. In such drawings.

DETAILED DESCRIPTION OF THE PREFERRED EMBODIMENT

Figure 1:
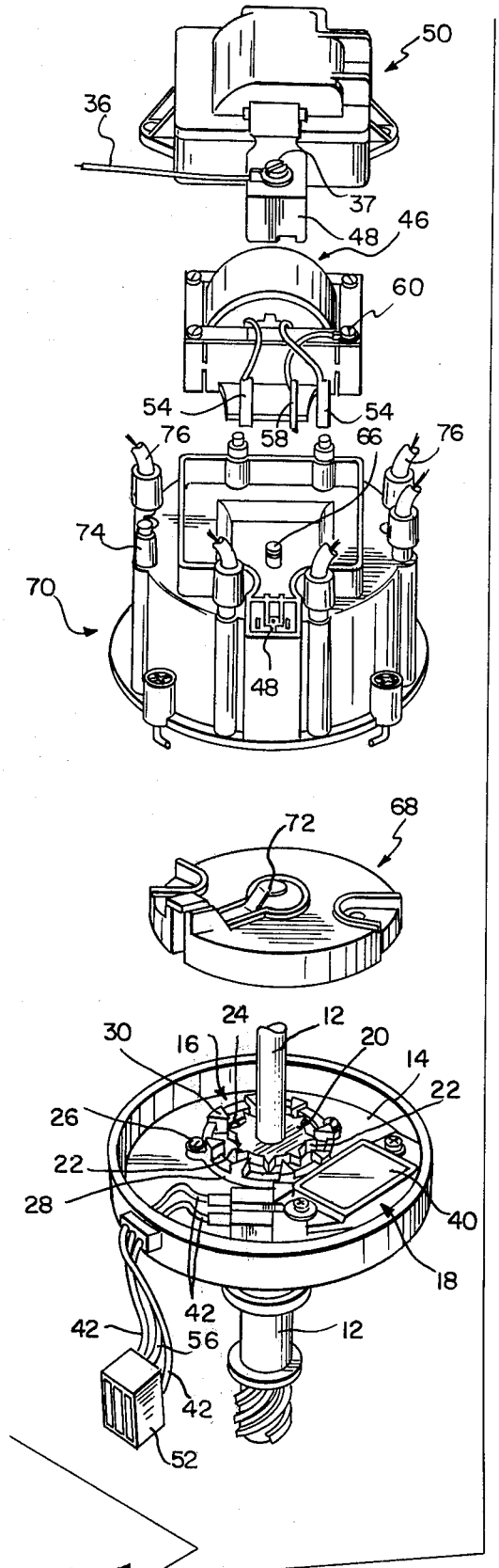
FIG. 1 is an exploded perspective view showing the essential components of a conventional electronic ignition system.

A distributor housing 10 of an electronic ignition system for an automobile engine is illustrated in exploded form in FIG. 1 to show the essential components of the electronic ignition system. The housing 10 has a central vertical shaft 12 which is coupled in a conventional manner to the engine crankshaft (not shown) for rotation thereby in accordance with engine speed. A base plate 14 closes the bottom of the housing, and serves as a mounting structure for an electronic pickup assembly 16 and an electronic control module 18.

The pickup assembly 16 shown in FIG. 1 comprises a low voltage magnetic generating unit having a circular armature 20 with a plurality of equally spaced peripheral teeth 22, one for each engine cylinder. The armature is mounted on the distributor shaft 12 for rotation therewith according to engine speed. A pickup coil 24 and a permanent magnet (not shown) thereunder are retained in position by screws 26 with respect to an annular pole piece 28 having internal teeth 30 corresponding in number and spacing with the teeth 22 on the armature. The sizes and shapes of the sets of teeth 22 and 30 are selected so that a carefully preset gap exists between them. In operation of the engine, the magnetic field from the permanent magnet is established through the pickup coil to induce a pickup coil voltage which is coupled to the electronic module 18, as will be hereafter described in more detail. At the same time, the rotating armature teeth 22 and the stationary pole piece teeth 30 continuously align and separate. As the teeth 22 and 30 approach alignment, the pickup coil voltage decreases until disappearing at the point of alignment and then reappearing with a different polarity upon further rotation. Thus, the pickup assembly produces a string of low voltage switching pulses timed in accordance with engine speed.

Some electronic ignition systems utilize an electronic pickup assembly unlike the one shown in FIG. 1. For example, an opto-electronic switch can be used. However, each type of electronic pickup assembly produces a string of low voltage switching pulses timed according to engine speed for connection to an electronic control module 18. Accordingly, only the magnetic pickup assembly 16 shown in FIG. 1 has been described in this application as representative of all pickup assemblies. Further, the pickup assembly shown in FIG. 1 can be combined with centrifugal weights (not shown) and vacuum mechanisms (not shown) to provide spark advance control, all in a well known manner.

Figure 2:
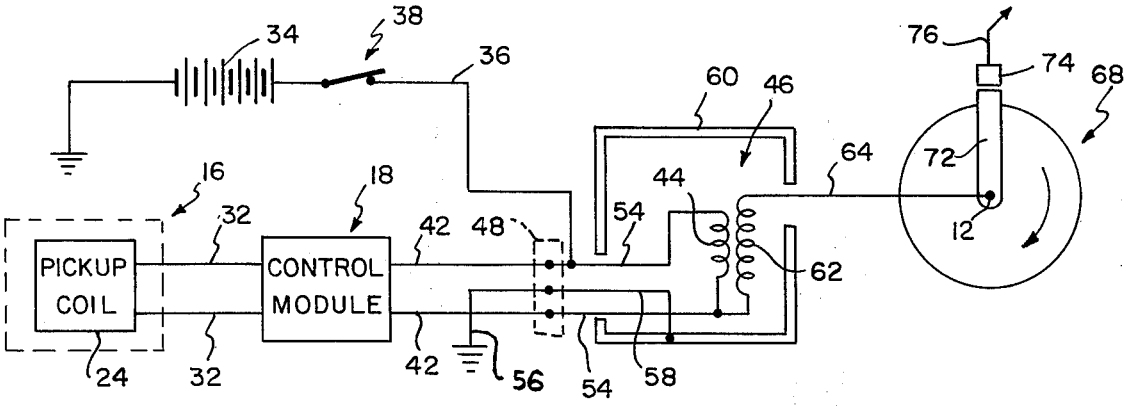
FIG. 2 is a schematic diagram representing the circuitry of the ignition system of FIG. 1.

As shown in FIGS. 1 and 2, the electronic module 18 is connected across the pickup coil 24 of the pickup assembly 16 by a pair of leads 32. This module 18 has power supplied thereto from the automobile storage battery 34, or from the generator if the engine is running, via a lead 36 into which is coupled a key-operated ignition switch 38. The module 18 is typically a small sealed housing 40 fastened to the distributor base plate 14 and contains a circuit board with microminiature electronic circuitry printed thereon.

The electronic module 18 has its output coupled by a pair of leads 42 across the primary winding 44 of the engine ignition coil 46. As shown in FIG. 1, this connection is accomplished by coupling the leads 42 into a socket 48 in the distributor cap 70 and cover 50 by means of an appropriately shaded adapter plug 52. This couples the leads 42 to terminals 54 of the ignition coil 46. Also, the lead 36 from the battery is connected to one of the terminals 54 in the socket via a terminal 37 or other suitable connection. And conveniently, a third lead 56 is provided in the adapter plug for coupling to the ignition coil terminal 58 to ground the ignition coil frame 60.

In operation, the module circuitry acts upon receipt of the low voltage switching pulses from the pickup coil 24 to open and close the current path through the ignition coil primary winding 44 in accordance with engine speed. This induces a corresponding frequency string of relatively high voltage pulses in the ignition coil secondary winding 62 which are electrically coupled through a lead 64 and a contact point 66 to a conventional rotor assembly 68 contained within the distributor housing cap 70. The rotor assembly has a rotor 72 rotated by the distributor shaft 12 to sequentially contact terminals 74, one for each engine spark plug, in the cap 70. Each terminal 74 is in turn connected via a wire 76 to one of the engine spark plugs so that the secondary pulses are distributed to the plugs to run the engine.

Any malfunction in either the pickup assembly 16 or the electronic module 18 prevents the switching of ignition pulses through the ignition coil primary winding 44. Accordingly, no high voltage pulses can be induced in the secondary winding 62 to thereby prevent any operation of the engine. As a result, when a malfunction occurs in either of the electronic components, the system must be repaired before the engine can again be started. However, as illustrated in FIG. 1, the electronic pickup assembly 16 is carefully and precisely positioned in the lower portion of the distributor housing alongside the sealed electronic module housing 40. Thus, repair of either electronic component is both time-consuming and difficult.

A bypass unit 80 of this invention is provided to bypass the pickup assembly 16 and the electronic module 18 when either of these electronic components breaks down. The unit 80 supplies low voltage ignition pulses across the ignition coil primary winding 44 to allow the engine to be started and operated for at least a short period of time. This permits a vehicle stranded with malfunctioning electronic ignition components to be driven to a safe and convenient repair location.

Figure 3:
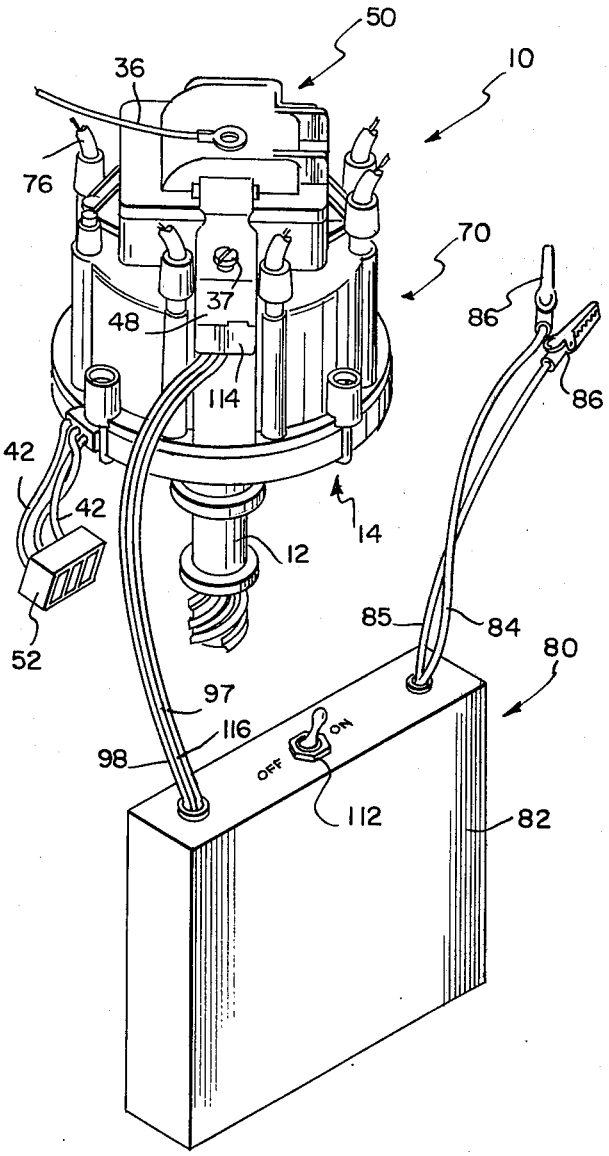
FIG. 3 is a perspective view of the ignition system distributor shown in FIG. 1, with a bypass unit of this invention connected thereto.
Figure 4:
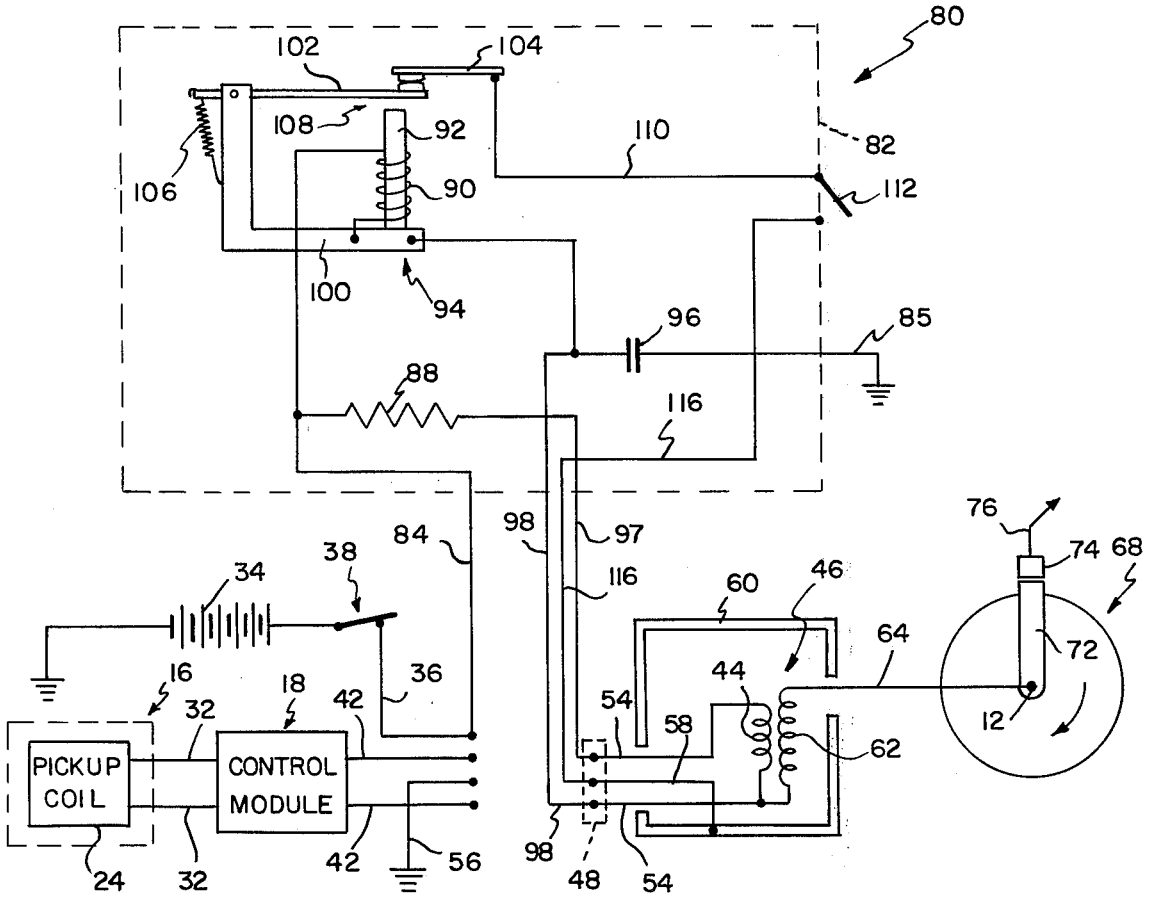
FIG. 4 is a schematic diagram similar to FIG. 2, and representing the circuitry of the bypass unit connected thereto.

As shown in FIGS. 3 and 4, the bypass unit 80 comprises a relatively small housing 82 having in practice a width and height of approximately 3 inches by 5 inches, and a thickness of approximately 2 inches. The unit is supplied with power by a pair of leads 84 and 85 extending therefrom, and having suitable clips 86 thereon for connection to the automobile storage battery 34. Such connection is accomplished as shown in FIG. 4 by connecting the lead 84 to the lead 36 from the ignition switch 38, and by connecting the lead 85 to a suitable grounding location on the engine. This permits the unit 80 to be controlled, as will hereafter be described in more detail, by the key-operated ignition switch. Alternately, the leads 84 and 85 can be connected directly to the positive and negative terminals of the storage battery.

The power supply lead 84 is electrically connected in parallel through a load resistor 88 to one output conductor 97 for connection to one side of the ignition coil primary winding 44, and to an induction coil 90 wound about a core 92 of a magnetic relay 94. The opposite end of the induction coil 90 is coupled in parallel to the ground lead 85 through a capacitor 96, and to a second output conductor 98 for connection to the side of the primary winding 44 opposite the conductor 97. The opposite end of the induction coil 90 is also connected through a conductive frame 100 of the magnetic relay 94 to one contact 102 of a pair of contacts 102 and 104. These contacts are retained in a normally closed condition by a suitable spring 106. Conveniently, the relay is adjusted in any known manner to provide a suitable gap, as at 108, between the magnetic core 92 and the one relay contact 102. The second relay contact 104 is connected by a conductor 110 to a manually operable on-off switch 112 mounted on the exterior wall of the unit housing 82. This switch is in turn connected to the ground lead 85.

The bypass unit 80 is used by first unplugging the existing adapted plug 52 from the socket 48 in the distributor cover 50. Then, the lead 36 from the ignition switch 38 is disconnected from the distributor cover 50. This removes all electrical connections of the ignition coil primary winding 44 with the pickup assembly 16, the electronic module 18, and the storage battery 34. All of these disconnected wires are readily accessible from the outside of the distributor housing to make the disconnection both fast and simple. The bypass unit power supply leads 84 and 85 are then respectively connected to the disconnected battery lead 36 and to a suitable ground. The unit output conductors 97 and 98 are then connected across the ignition coil primary winding 44. Conveniently, these output leads are carried in an appropriately shaped adapter plug 114 for fast and easy direct connection into the distributor socket 48. Also, if desired, the unit adapter plug 114 couples a ground wire 116 between the coil ground lead 58 and the unit ground lead 85 to provide a grounding path for the ignition coil frame 60.

To operate the bypass unit, the ignition switch 38 and the unit on-off switch 112 are closed. This provides a current path from the storage battery 34 to ground through both the induction coil 90 and the ignition coil primary winding 44. When a sufficient magnetic charge resulting from current flow builds up in the induction coil 90, the contacts 102 and 104 are magnetically opened to cut off current flow through the induction coil and the primary winding. This causes the magnetic field in each to collapse, and thereby generates a low voltage pulse in the primary winding which in turn induces a relatively high voltage pulse in the secondary winding 62 of the ignition coil. At the same time, the relay spring 106 moves the contacts back to their normally closed positions to again complete the current path through the coil 90 and the primary winding 44 for another cycle.

The ignition pulses induced in the secondary winding 62 are coupled via the conductor 64 to the rotor 72 of the rotor assembly 68. Thus, the engine can be started with the bypass unit 80 connected thereto by cranking the engine by means of the engine starter motor (not shown). This rotates the rotor 72 to sequentially distribute the secondary ignition pulses through the spark plug terminals 74 to fire the engine spark plugs and enable the engine to run. The stranded vehicle can then be driven to a safe repair area with the existing electronic ignition components completely disconnected from the ignition coil.

The frequency of the ignition pulses generated by the vibrating relay 94 is independent of engine speed, and is therefore independent of the contacting of the spark plug terminals 74 by the rotor 72 of the rotor assembly. The relay frequency is, however, adjustable by varying the field strength of the induction coil 90, the length of the gap 108 between the coil and relay contacts, or the spring constant of the relay spring 106. In actual practice, the relay 94 is adjusted to generate low voltage pulses at a frequency of anywhere from about 400 to about 3,400 times each second with a frequency range of about 2,000 to about 2,500 cycles per second being preferred for optimum performance. This frequency induces a corresponding number of high voltage pulses in the secondary circuit for distribution to the spark plugs. While the frequency is unrelated to engine speed, a sufficient number of the high voltage pulses correspond with the contacting of a spark plug terminal by the rotor 72 to start the engine with minimal bucking. Further, a sufficient number of the ignition pulses correspond with the contacting of terminals 74 by the rotor to permit the engine to be operated throughout a fairly normal speed range. Thus, the bypass unit of this invention can be quickly and easily coupled into an automobile ignition system to bypass malfunctioning electronic components and permit temporary engine operation so that the vehicle can be moved from its stranded location to a safe repair area.

The bypass unit of this invention also provides an effective diagnostic tool for pinpointing ignition system problems. That is, if the engine starts when the bypass unit is connected thereto, then the technician knows that the malfunction in the ignition system is in either the bypassed pickup assembly or electronic control module. By alternately replacing these two electronic components, the technician can specifically locate and correct the problem.

I claim:

1. In an internal combustion engine having an ignition coil with a primary and a secondary winding, electronic means for supplying ignition pulses in accordance with engine speed to the primary winding to induce relatively high voltage pulses in the secondary winding for distribution to engine spark plugs, and a storage battery for supplying power to said electronic means, an ignition system bypass unit for bypassing the electronic means when a malfunction occurs therein comprising a relatively high frequency pulse generating means having a magnetic coil and a pair of normally closed contacts electrically connected in series therewith, a pair of first leads for electrically connecting said pulse generating means across the storage battery to energize said generating means, and a pair of second leads for electrically connecting said magnetic coil in parallel with the ignition coil primary winding and said contacts in series with the ignition coil primary winding, said magnetic coil being operative to alternately magnetically open said contacts to cause collapse of a magnetic field and to allow said contacts to return to a normally closed position whereby a relatively high frequency string of ignition pulses is applied to the primary winding to induce a corresponding frequency string of relatively high voltage pulses in the secondary winding for distribution of the engine spark plugs to allow at least temporary operation of the engine.

2. A bypass unit as set forth in claim 1 wherein said pulse generating means is contained within a unitary housing having said pairs of first and second leads extending therefrom.

3. A bypass unit as set forth in claim 2 with the addition of switch means mounted on said housing and electrically coupled to said pulse generating means for selectively controlling the operation thereof.

4. A bypass unit as set forth in claim 1 wherein said magnetic coil is operative to open and close said contacts at a frequency of from about 400 cycles per second to about 3,400 cycles per second.

5. In an internal combustion engine having an ignition coil with a primary and a secondary winding, electronic means having conductors carried in an adapter plug for reception in a socket to connect said means to the primary winding to supply the same with ignition pulses in accordance with engine speed to induce relatively high voltage pulses in the secondary winding for distribution to engine spark plugs, and a storage battery for supplying power to said electronic means, an ignition system bypass unit for bypassing the electronic means when a malfunction occurs therein and said electronic means is disconnected from the storage battery and primary winding comprising a housing relatively high frequency pulse generating means mounted within said housing, said pulse generating means having a magnetic coil and a pair of normally closed contacts electrically connected in series therewith, a pair of first leads for electrically connecting said pulse generating means across the storage battery to energize said generating means, and a pair of second leads carried in a unit adapter plug shaped for reception in the socket to connect the magnetic coil of said pulse generating means in parallel with the primary winding of the ignition coil and to connect said contacts in series with the primary winding of the ignition coil, said magnetic coil being operative to alternately magnetically open said contacts to cause collapse of a magnetic field and to allow said contacts to return to a normally closed position whereby a relatively high frequency string of ignition pulses is applied to the primary winding to induce a corresponding frequency string of relatively high voltage pulses in the secondary winding for distribution to the engine spark plugs to allow at least temporary operation of the engine.

6. A bypass unit as set forth in claim 5 with the addition of switch means mounted on said housing and electrically coupled to said pulse generating means for selectively controlling the operation thereof.

* * * * *